US005470152A

United States Patent [19]

Rains

[11] Patent Number: 5,470,152

[45] Date of Patent: Nov. 28, 1995

[54] RADIALLY MOUNTED MAGNETIC COUPLING

[75] Inventor: Robert L. Rains, Oxnard, Calif.

[73] Assignee: General Signal Corporation, Stamford, Conn.

[21] Appl. No.: 346,348

[22] Filed: Nov. 29, 1994

Related U.S. Application Data

[63] Continuation of Ser. No. 21,027, Feb. 23, 1993, abandoned.

[51] Int. Cl.[6] ..... B01F 13/08

[52] U.S. Cl. ..... 366/273; 366/274; 366/314; 366/331

[58] Field of Search ..... 366/273, 274, 366/342, 343, 331, 138, 279, 314, 169; 464/29

[56] References Cited

U.S. PATENT DOCUMENTS

| | | | |
|---|---|---|---|
| 4,013,384 | 3/1977 | Oikawa | 417/368 |
| 4,115,040 | 9/1978 | Knorr | 417/420 |
| 4,209,259 | 6/1980 | Rains et al. | 366/273 |
| 4,390,283 | 6/1983 | Meyer | 366/142 |
| 4,534,656 | 8/1985 | de Bruyne | 366/247 |
| 4,653,519 | 3/1987 | Kanner | 366/273 X |
| 4,665,736 | 5/1987 | Yokoyama et al. | 366/273 X |
| 4,752,138 | 6/1988 | Rufer | 366/273 X |
| 4,836,826 | 6/1989 | Carter | 464/29 |
| 4,993,841 | 2/1991 | Löfgren et al. | 366/274 |
| 5,061,079 | 10/1991 | Shiobara | 366/127 |

*Primary Examiner*—David Scherbel
*Assistant Examiner*—Patrick F. Brinson
*Attorney, Agent, or Firm*—Blakely Sokoloff Taylor & Zafman

[57] ABSTRACT

An agitator tank with a magnetically coupled mixer. The mixer includes a drive magnet that is connected to a drive shaft. The drive magnet and drive shaft are both located within a drive housing that is fastened to the tank in a sealess fashion. The housing separates the drive magnet from a driven magnet that is attached to an impeller. The magnets are magnetically coupled so that rotation of the drive magnet induces a rotation of the driven magnet and impeller. The drive shaft is coupled to a motor which rotates the shaft and the drive magnet. The magnets are oriented so that the coupling surface of each magnet is essentially parallel with the longitudinal axis of the drive shaft, preferably in a circular pattern around the center of the shaft.

10 Claims, 3 Drawing Sheets

RADIALLY MOUNTED MAGNETIC COUPLING

This is a continuation of application Ser. No. 08/021,027, filed Feb. 23, 1993, now abandoned.

BACKGROUND OF THE INVENTION

1. Field of the Invention

The present invention relates to an agitator tank that contains a magnetically coupled mixer.

2. Description of Related Art

Chemical compounds are typically mixed within an agitator tank that contains a rotating mixer. Agitator tanks are frequently used to mix ingredients for pharmaceuticals which require a very sterile environment during the mixing process. For example, the Food and Drug Administration (FDA) has recently promulgated strict sterile requirements on solutions being processed for intravenous use. The dangers of cell growth within the tank are of particularly concern. To provide a sterile environment, agitator tanks must be constructed to prevent contaminants from entering or remaining in the tanks during a batch process.

A typical agitator tank includes a drive shaft that couples a mixing impeller to a motor located outside of the tank. The mixers contain seals located between the drive shaft and the body of the tank. Seals are undesirable because such components are susceptible to failure, and are difficult to clean and replace. Additionally, the sealed mixers are typically located at the top of the tank. Overhead mixers are relatively inefficient in mixing, particularly ingredients located at the bottom of the tank.

To reduce the amount of sealing in an agitator tank, some tanks contain magnetic couplers which couple the mixing impeller to a motor located exterior to the tank. Magnetic couplers have a drive magnet attached to the motor and a driven magnet connected to the impeller. The magnets are assembled close together, so that rotation of the drive magnet rotates the driven magnet and impeller. The magnetic coupler allows the mixing impeller to be rotated by the motor without mechanically connecting the two members. Magnetic couplers can therefore be constructed so that there is no seal associated with the mixing impeller. Additionally, magnetic couplers typically require less horsepower than conventional overhead mixers.

Present magnetic couplers have a plurality of horizontally located magnets which couple the impeller to the motor. The magnetic force between the magnets of present couplers is relatively small, thereby limiting the size of the motor. For example, present magnetically coupled motors do not typically exceed 1.5 horsepower. The small magnetic forces can result in magnetic decoupling when the load on the impeller is greater than the torque of the magnets. The size of the tank and the viscosity of the contents is therefore limited to the size of the mixing motor. It would therefore be desirable to have a sealess mixer which can create a relatively large output torque. It would also be desirable to have a sealess mixer which was efficient in mixing the contents of an agitator tank.

SUMMARY OF THE INVENTION

The present invention is an agitator tank with a magnetically coupled mixer. The mixer includes a drive magnet that is connected to a drive shaft. The drive magnet and drive shaft are both located within a drive housing that is fastened to the tank in a sealess fashion. The housing separates the drive magnet from a driven magnet that is attached to an impeller. The magnets are magnetically coupled so that rotation of the drive magnet induces a rotation of the driven magnet and impeller. The drive shaft is coupled to a motor which rotates the shaft and the drive magnet.

The magnets are oriented so that the coupling surface of each magnet is essentially parallel with the longitudinal axis of the drive shaft, preferably in a circular pattern around the center of the shaft. The parallel circular magnets create large coupling surfaces which generate relatively large magnetic forces between the magnets. The magnetically coupled mixer of the present invention can therefore be used with bigger motors and larger tanks than couplers of the prior art.

Therefore it is an object of the present invention to provide a sealess mixer for an agitator tank.

It is also an object of the present invention to provide a sealess mixer which produces a relatively large amount of torque.

BRIEF DESCRIPTION OF THE DRAWINGS

The objects and advantages of the present invention will become more readily apparent to those ordinarily skilled in the art after reviewing the following detailed description and accompanying drawings, wherein.

DETAILED DESCRIPTION OF THE INVENTION

Figure 1:
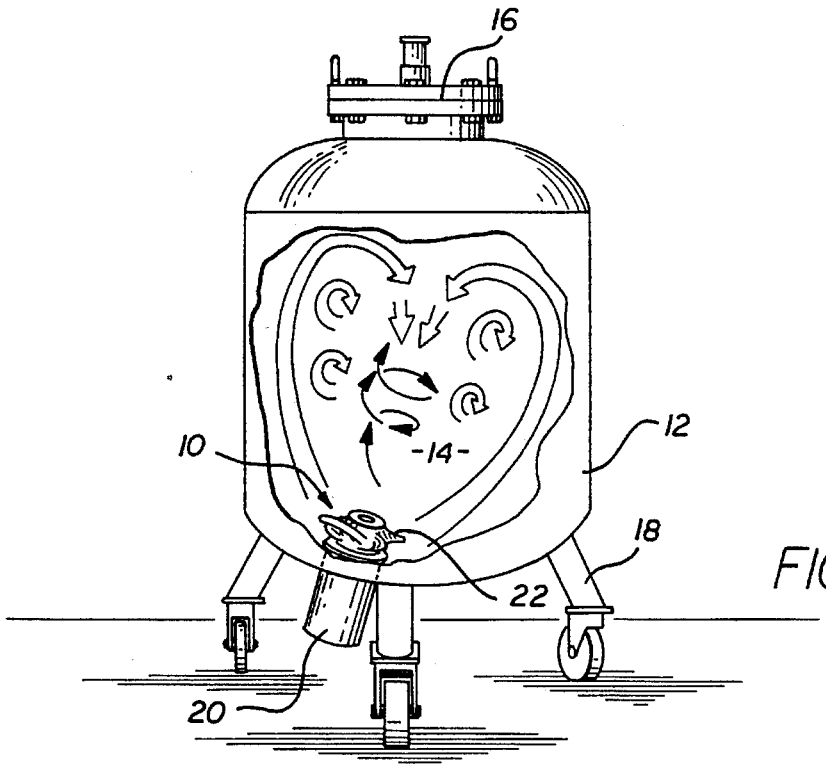
FIG. 1 is a perspective view of a magnetically coupled mixer located within an agitator tank.

Referring to the drawings more particularly by reference numbers, FIG. 1 shows a magnetically coupled mixer 10 mounted to an agitator tank 12. The tank has an inner cavity 14 that is typically enclosed by a lid 16. The agitator tank 12 may also have a plurality of legs 18 that support and lift the tank.

The mixer 10 includes a motor 20 that is coupled to an impeller 22, which rotates within the inner cavity 14 of the tank 12. Rotation of the impeller 22 mixes that contents of the agitator tank by inducing movement and creating vortices in the tank. The tank typically contains fluid compounds that are used to create chemical or pharmaceutical products. The motor may be electrical, hydraulic or any other motor type known in the art. It is preferable to use a nonelectric motor when the contents of the tank are highly combustible.

Figure 2:
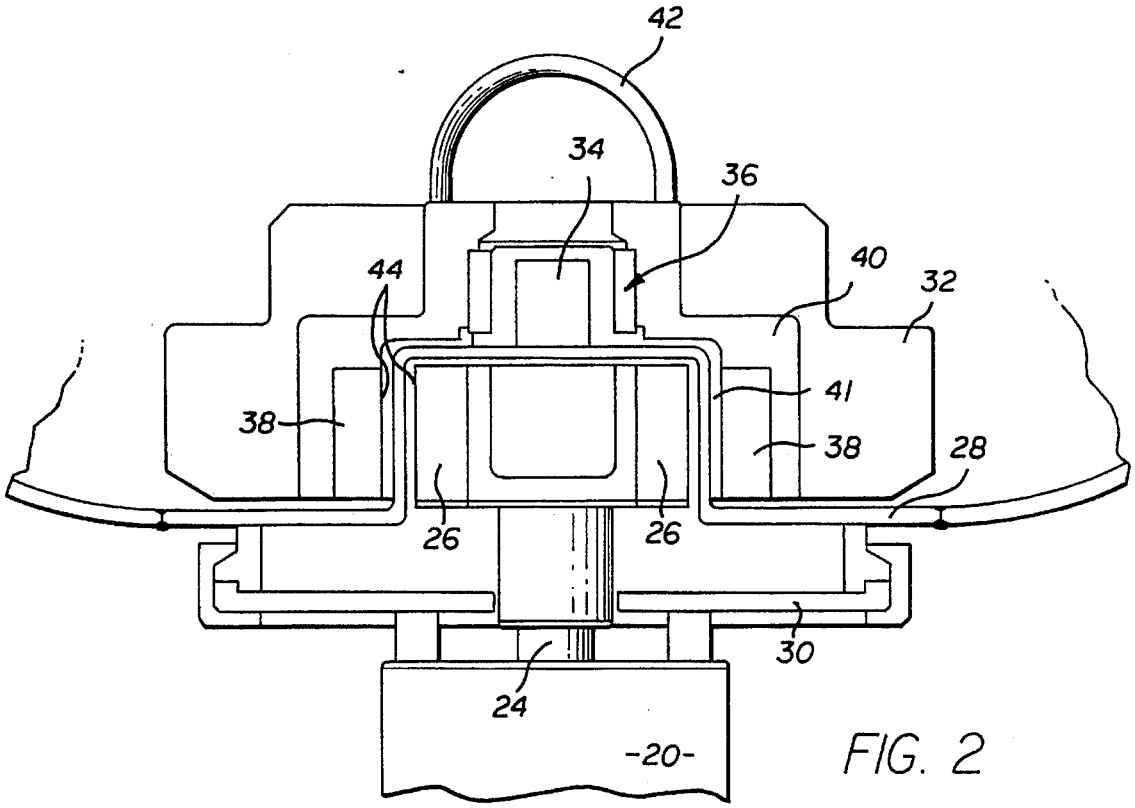
FIG. 2 is a cross-sectional view of the magnetically coupled mixer.

As shown in FIG. 2, the motor 20 has a drive shaft 24 that is attached to a plurality of drive magnets 26. The drive shaft 24 and drive magnets 26 are enclosed by a drive housing 28. The drive housing 28 is typically welded to the agitator tank 12 so that no contaminants can enter the inner cavity 14. The motor 20 may be coupled to the drive housing 28 by a clamp plate 30 that is adapted to allow the operator to readily remove the motor for replacement or repair. The drive housing 28 typically extends into the inner cavity 14 of the tank 12.

The impeller 22 includes a plurality of blades 32 that can rotate about an impeller shaft 34 that extends from the drive housing 28. Located between the impeller 22 and the impeller shaft 34 is a bearing assembly 36 that allows relative rotation between the two members. The impeller 22 has a plurality of driven magnets 38 located adjacent to the drive magnets 26. The driven magnets 38 are magnetically coupled to the drive magnets 26, so that rotation of the drive magnets 26 induces a rotation of the driven magnets 38. The driven magnets 38 are typically coupled to the impeller 22 by a steel backplate 40 and contained by an inner frontplate 41. The impeller 22 may also have a hook 42 which allows the operator to drop the impeller unit in place during the assembly of the mixer 10.

Figure 3:
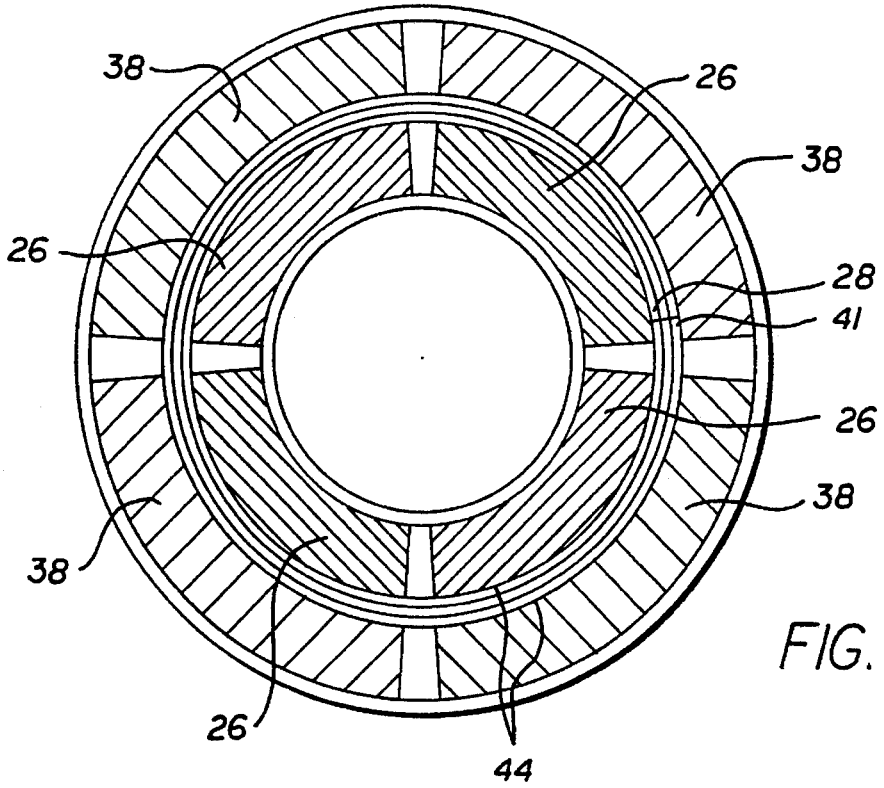
FIG. 3 is a cross-sectional top view showing a radial arrangement of the magnets of the magnetically coupled mixer.
Figure 4:
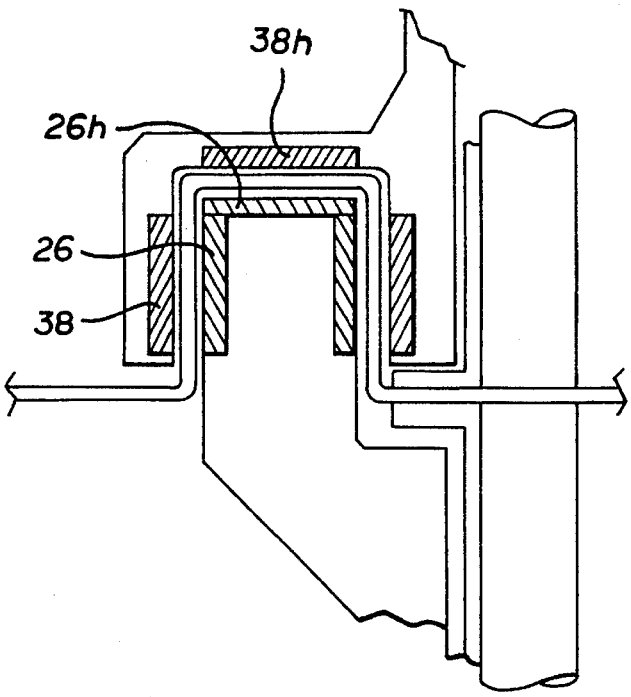
FIG. 4 is a cross-sectional view of an alternate arrangement of magnets within the mixer.

The drive 26 and driven 38 magnets are oriented so that the coupling surfaces 44 of the magnets are essentially parallel with the longitudinal axis of the drive shaft 24. As shown in FIG. 3, both the drive 26 and driven 38 magnets are radially mounted so that the magnets are arranged in a circular pattern around the drive shaft 24. The radial parallel orientation of the magnets provides a relatively large coupling area between the two members. The large coupling area creates a relatively large magnetic force between the magnets. The magnetic coupling mixer of the present invention can thus be used with motors having relatively high horsepower, and can mix relatively large loads without experiencing decoupling of the magnets. FIG. 4 shows an alternate embodiment, wherein there are additional magnets **26*h* and 38*h*** that are oriented so that the coupling surfaces of the additional magnets are essentially perpendicular to the drive shaft. Such an arrangement further increases the magnetic force between the drive and driven magnets.

Figure 5:
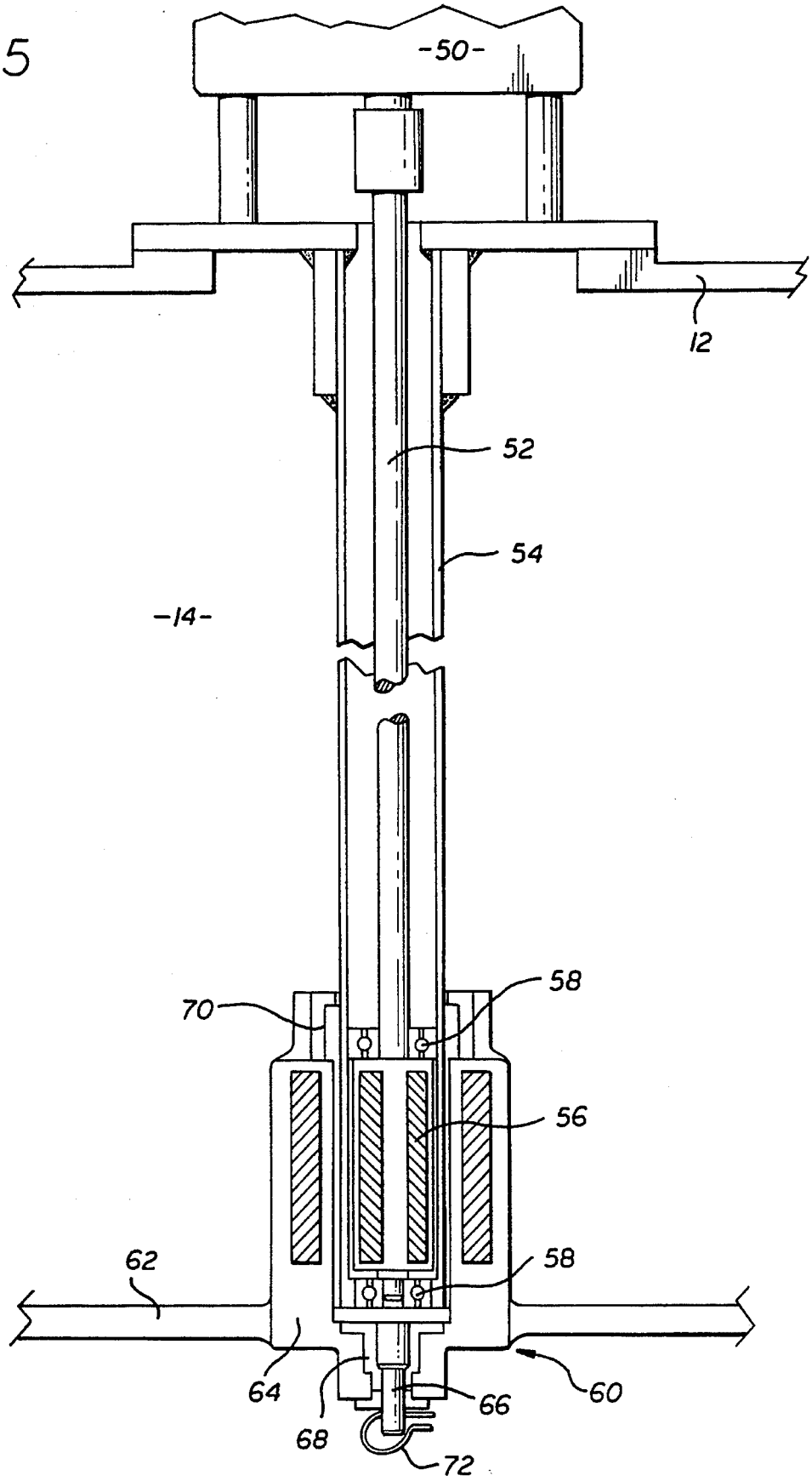
FIG. 5 is a cross-sectional view of an alternate embodiment of the magnetically coupled mixer.

FIG. 5 shows another alternate embodiment of the present invention. The motor 50 is mounted to the top of the tank and the drive shaft 52 and drive housing 54 extend across the inner cavity 14 toward the bottom of the tank 12. The drive magnets 56 are supported within the housing 54 by a radial bearing **58*a* and thrust bearing 58*b***.

The impeller 60 has a plurality of blades 62 that are attached to an impeller housing 64. The impeller 60 rotates about an impeller shaft 66 that extends from the drive housing 54. The impeller housing 64 is separated from the impeller shaft 66 and drive housing 54 by a lower impeller bearing assembly 68 and an upper impeller bearing assembly 70, respectively. The impeller 60 is secured to the drive housing 54 by a clip 72.

The drive housing 54 is welded to a plate 74 that is welded to the tank. The housing 54 and plate 74 are attached to the tank so that contaminants cannot enter the inner cavity 14. The mixer shown in FIG. 5 provides an overhead magnetic coupled mixer which generates relatively high output torques.

What is thus provided is a sealess mixer that provides a large output torque. Such a high powered mixer can be used to efficiently mix the contents of a relatively large tank.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A magnetic coupled mixer for a tank that has an inner cavity, comprising:

a drive shaft with a longitudinal axis;

a motor that rotates said drive shaft;

a drive magnet that is rotated by said drive shaft, said drive magnet having a first coupling surface that is essentially parallel with said longitudinal axis of said drive shaft;

a driven magnet magnetically coupled to said drive magnet, said driven magnet having a second coupling surface that is essentially parallel with said first coupling surface of said drive magnet to rotate with said rotation of said drive magnet, said driven magnet being adapted to rotate when said drive magnet is rotated; and, a magnetically conductive back plate attached to said driven magnet;

a front plate that is attached to said back plate and which together with said back plate enclose said driven magnet;

second drive and driven magnets magnetically coupled, with respective coupling surfaces perpendicular to Said longitudinal axis of said drive shaft; and an impeller plate attached to said back plate.

2. The mixer as recited in claim 1, further comprising a drive housing that is attached the tank and located between said drive magnet and said driven magnet.

3. The mixer as recited in claim 2, wherein said drive housing extends into the inner cavity of the tank.

4. The mixer as recited in claim 1, further comprising a plurality of drive magnets arranged in a circular pattern about said longitudinal axis of said drive shaft and a plurality of driven magnets arranged in a circular pattern about said longitudinal axis of said drive shaft.

5. The mixer as recited in claim 2, further comprising an impeller bearing assembly located between said impeller and an impeller shaft that extends from said drive housing.

6. An agitator tank system, comprising:

a tank having an inner cavity, a top portion and a bottom portion;

a motor;

a drive shaft coupled to said motor and extending from said top portion of said tank toward said bottom portion of said tank, said drive shaft having a longitudinal axis and an unsupported end located within said tank opposite from said motor;

a drive magnet that is rotated by said drive shaft, said drive magnet being located at said unsupported end of said drive shaft and having a first coupling surface that is essentially parallel with said longitudinal axis of said drive shaft;

a driven magnet magnetically coupled to said drive magnet to rotate with said rotation of said drive magnet, said driven magnet having a second coupling surface that is essentially parallel with said first coupling surface of said drive magnet;

a drive housing attached to said tank and enclosing said drive magnet and said drive shaft, said drive housing being located between said drive magnet and said driven magnet;

a radial bearing that couples said drive shaft to said drive housing;

a thrust bearing that couples said drive shaft to said drive housing; and, an impeller coupled to said driven magnet to rotate when said driven magnet is rotated.

7. The tank as recited in claim 6, wherein said drive housing extends into said inner cavity of said tank.

8. the tank as recited in claim 6, further comprising a plurality of drive magnets arranged in a circular pattern about said longitudinal axis of said drive shaft and a plurality of driven magnets arranged in a circular pattern about said longitudinal axis of said drive shaft.

9. The tank as recited in claim 8, further comprising impeller bearings located between said impeller and said drive housing.

10. The tank as recited in claim 9, further comprising drive and driven magnets with coupling surfaces that are essentially perpendicular to said longitudinal axis of said drive shaft.

* * * * *